US005438778A

United States Patent [19]

Komamura

[11] Patent Number: 5,438,778

[45] Date of Patent: Aug. 8, 1995

[54] FRAME

[76] Inventor: Takeo Komamura, Nakakanasugi, Matsudo-shi, Chiba, Japan

[21] Appl. No.: 88,949

[22] Filed: Jul. 12, 1993

Related U.S. Application Data

[63] Continuation of Ser. No. 904,932, Jun. 26, 1992, Pat. No. 5,279,056, which is a continuation of Ser. No. 580,222, Sep. 10, 1990, Pat. No. 5,189,820.

[30] Foreign Application Priority Data

May 23, 1990 [JP] Japan ..... 2-131157

[51] Int. Cl.[6] ..... G09F 1/12

[52] U.S. Cl. ..... 40/156

[58] Field of Search ..... 40/156, 154, 152, 152.1, 40/155, 107, 574, 575, 603, 611, 647

[56] References Cited

U.S. PATENT DOCUMENTS

| | | | |
|---|---|---|---|
| 1,845,334 | 2/1932 | RitzWoller | 40/155 X |
| 2,633,653 | 4/1953 | Angus et al. | 40/155 X |
| 2,804,952 | 9/1957 | Nothdurft | 40/155 X |
| 3,310,901 | 6/1965 | Sarkisian | 40/156 |
| 3,579,882 | 5/1971 | Miyahune | 40/107 |
| 4,107,897 | 8/1978 | Ullman, Jr. . | |
| 4,512,095 | 4/1985 | Seely | 40/156 |
| 4,702,025 | 10/1987 | Mace | 40/156 |
| 4,714,373 | 12/1987 | Heekin | 40/155 X |
| 4,835,891 | 6/1989 | Joffe | 40/156 X |
| 4,862,612 | 9/1989 | Sugihara et al. | 40/155 |
| 4,937,959 | 7/1990 | Palmer et al. | 40/156 |
| 4,993,866 | 2/1991 | Sugihara et al. | 40/155 X |
| 5,058,297 | 10/1991 | McGinnis | 40/155 |

FOREIGN PATENT DOCUMENTS

| | | | |
|---|---|---|---|
| 2076339 | 10/1971 | France . | |
| 39-26439 | 11/1964 | Japan . | |
| 48-27318 | 8/1973 | Japan . | |
| 50-24390 | 7/1975 | Japan . | |
| 63-161565 | 10/1988 | Japan . | |
| 1574142 | 9/1980 | United Kingdom . | |
| 2106691 | 4/1983 | United Kingdom . | |
| 2223874 | 4/1990 | United Kingdom | 40/156 |

*Primary Examiner*—Kenneth J. Dorner
*Assistant Examiner*—Joanne Silbermann
*Attorney, Agent, or Firm*—Lowe, Price, LeBlanc & Becker

[57] ABSTRACT

A frame, including a plurality of frame elements 1 and at least one connecting corner element 5 on which the frame elements 1 are mounted in intersected relation, is provided to form a readily accessed enclosure to accommodate therein an article, a glass plate to allow viewing of the article, a backing plate at the rear and an illumination louver. At least one of the frame elements 1 is mounted to the connecting corner element 5 for relative angular movement therebetween, to facilitate easy opening of the enclosure and access to the space defined therein.

11 Claims, 15 Drawing Sheets

FRAME

This is a Continuation of U.S. application Ser. No. 07/904,932, filed on Jun. 26, 1992 now U.S. Pat. No. 5,279,056, which is a continuation of U.S. application Ser. No. 07/580,222 filed on Sep. 10, 1990, which issued on Mar. 2, 1993 as U.S. Pat. No. 5,189,820.

BACKGROUND OF THE INVENTION

1. Field of the Invention

The present invention relates to a frame in which a plurality of frame elements are angularly connected to each other through at least one connecting element to form an enclosure, to accommodate therein an article such as a picture, a photograph, a glass plate, a rear plate, an illumination louver, a smoothly planed board for a building interior trim, or the like.

2. Description of the Prior Art

A frame is disclosed in Japanese Patent Publication No. 26439/1964 in which a plurality of frame elements are connected respectively through a plurality of connecting elements to form an enclosure.

That is, the above Japanese Patent Publication No. 26439/1969 discloses the connecting elements which are formed respectively with connection engaging pawls which engage respectively with the frame elements. Each of the connection engaging pawls is formed on a surface of an L-shaped element in the form of a thin plate.

The connection element utilizes the connection engaging pawl to engage with the frame element. In the case where the article to be accommodated is mounted to or demounted from the interior of the frame in order to form the latter, the connection engaging pawl of the connecting element must be operated each time to demount the frame element from the frame.

Japanese Utility Model Publication No. 27318/1973 discloses other types of connecting elements.

Disclosed in the above Japanese Utility Model Publication No. 27318/1973 is a connecting element in which a plain or flat plate is folded perpendicularly to form a connecting arm, and the connecting arm is formed with an inclined surface.

A dovetail groove in the frame element is inserted into the connecting arm, and an inclined surface of the connecting arm is tightened by screws from the side portion of the dovetail groove, so that the frame element is connected to the connecting element.

The connecting arm is inserted through the end of the dovetail groove of the frame, and an engaging pawl or a screw serves as a wedge and is engaged with the connecting arm, so that the frame element is connected to the connecting element.

Since the frame element is connected to and fixed to the connecting arm of the connecting element so that the frame is formed, the article accommodated in the frame can be taken out or removed such that the frame element is moved to its open position from the opposed connecting arms of the respective left- and right-hand connecting elements, and is separated from the connecting arm of the connecting element.

Alternatively, the articles to be accommodated can be removed in the following manner. That is, the frame element is moved to its open position from the opposed connecting arms of the respective left- and right-hand connecting arms. The dovetail groove is utilized to move the frame element from the left- and right-hand connecting arms to enlarge the frame. An engaging section of the frame element is removed from the front-face peripheral edge section of the article to be accommodated.

Subsequently, another article to be accommodated is inserted into a space within the frame between the frame elements thereof. The connecting arm of the connecting element is pushed into the frame element. The frame element is again connected and engaged by the connecting arm. Thus, the frame is formed.

Furthermore, a plurality of frame elements cooperating with each other to form a frame are disclosed in Japanese Utility Model Publication No. 24390/1975.

Disclosed in the above Japanese Utility Model Publication No. 24390/1975 is such an arrangement that, in order to mount and demount the article to be accommodated to and from each of the frame elements which cooperate with each other to form the frame, the frame element is composed of a pair of upper and lower frame elements. The upper frame element is assembled to the lower frame element so as to be angularly movable thereto partially. The lower and upper frame elements are abutted against each other by a spring. The article to be accommodated is held between the upper and lower frame elements.

Replacement of the article to be accommodated with respect to the frame, which are formed by the frame elements, is practiced in the following manner. That is, the upper frame element is angularly moved upwardly through about 90 degrees to rise, as a fulcrum of a portion at which the lower and upper frame elements are assembled with each other for angular movement. The upper frame elements rise subsequently, to open the upper edges at the four sides of the frame. The article to be accommodated is mounted to and demounted from the open face.

Further, a record-jacket holding panel is disclosed in Japanese Utility Model Provisional Publication No. 161565/1988 in which a lower frame element and an upper frame element are connected to each other through a film hinge, to form a frame.

In the above Japanese Utility Model Provisional Publication No. 161565/1988, a plurality of frame elements are framed such that their respective end faces are abutted against each other, and a rear plate is held along the outer periphery of the rear plate. The frame elements have their respective front-face elements and respective rear-face elements whose respective outer surface portions are connected to each other through a hinge. A spring is provided between the front-face element and the rear-face element. By the spring, the front-face element is biased such that record jackets superimposed upon the rear plate are clamped with respect to the rear plate. The front-face element is movable angularly about a hinge section against the spring. A record-jacket pushing bore is formed through the rear plate.

Mounting and demounting of the article to be accommodated to and from the frame are practiced from the frame front surface, as follows. That is, the front-face elements of the four-side frame elements rise upwardly about 90 degrees, and the upper edge of the frame is open.

SUMMARY OF THE INVENTION

It is an object of the invention to provide a frame which is so simple in construction that, when an article to be accommodated is mounted and demounted, a plurality of frame elements are not removed from at least one connecting element, and that two frame elements having a lower frame element and an upper frame element are not connected to the connecting element. Each of the frame elements, in a simple frame structure, is engaged with the connecting elements for angular movement.

It is another object of the invention to provide a frame in which each of a plurality of frame elements is mounted to at least one connecting element so as to be movable angularly about a longitudinal axis of the frame element, whereby a side plate of the connecting element serves also as a falling-out preventing section with respect to a bearing section for the angularly movable frame element. Thus, when the frame element is moved angularly with respect to its open position, the frame element does not fall down and, for this reason, it is possible to easily move an article to be accommodated into and out of the frame.

It is still another object of the invention to provide a frame which is extremely simple in construction, which involves no waste of material, and which is easy to use in many applications.

A frame according to the invention can be utilized, for example, for building fittings or fixtures, furniture, an exhibition case, a signboard, an illumination appliance, or the like.

In the invention, only fitting between two kinds of elements including a frame element molding-processed by extrusion of aluminum or the like and a connecting corner element molded from elastic resin such as polycarbonate, polyacetal or the like, enables each frame element to be connected to the connecting element for angular movement to form the frame. The frame element on one side of the frame is angularly moved outwardly to open one side edge of the frame. Thus, taking-in and-out of the article to be accommodated including the rear plate and the like can easily be done through the open location, without breaking the frame.

An intermediate partition is provided within the frame element to divide the space into two space sections. One of the two space sections is brought to a space for holding the front-face peripheral edge portion of the article to be accommodated. The other space section is brought to a space in which the connecting element is fitted.

An inward flange is provided at an outward end of the space in the frame element, in which the connecting element is fitted, so that a concave bearing section is formed.

In one aspect of the invention, the distance from the outward side of an angularly-movable shaft of the connecting element to an angular-movement stoppage section and a distance from a concave bearing section of the frame element to an engaging pawl is made equal to each other or is equalized each other, whereby an opening width of the fitting space in the frame element with respect to the connecting element is narrowed correspondingly to the projecting portion of the flange.

Further, the projecting dimension of the flange is equal to or larger than one half the thickness of the shaft at the forward end of the side plate.

The corner of the side plate of the connecting element is cut out to form a convex shaft at the end of the side plate.

The convex shaft is provided at the forward end of the side plate which serves as a leaf spring.

A convex, concave or any other engaging section for prevention of getting-out may be provided at a location engaged with the intermediate partition of the frame element or the connecting section between the shaft section and the connecting element.

An angular-movement stoppage section is provided at a position where the engaging pawl is abutted against the connecting element, and at a location where the frame element is moved to its closed position, or where the frame element is moved to its fully open position.

Another angular-movement stoppage section is provided on an angular-movement sliding contact face between the connecting element and the frame element. The angular-movement stoppage section is provided midway of angular movement of the frame element, a location where the frame element is open to the maximum, a location where the frame element is closed, or the like.

An angular-movement engaging pawl is provided on the outer periphery concentric with a center of the concave bearing section, that is, on the intermediate partition.

In the case where the article to be accommodated is held between the intermediate partition of the frame element and the front-face engaging section, the intermediate partition is brought to a curved surface concentric with the concave bearing section.

The connecting element is arranged such that, when the frame element is moved to its open position, the rear-face section of the connecting element projects as compared with the position of the rear-face portion of the frame element.

A cut-out may be provided at the end of the flange. The cut-out has such a dimension that its length is of the order to two times a distance from the center of the convex shaft section to the frame-element surface of the concave shaft section.

At this time, a step is provided above the cut-out of the frame element.

A tongue-like spring, which has, at its forward end, an inclined surface and which can be urged against a part of the connecting element, may be provided at a position where the frame element is moved to its closed position, that is, at the angular-movement stoppage position.

The tongue-like spring provided on the connecting element has a forward end which may be brought to a hook-shaped engaging pawl.

In this case, the tongue-like spring is formed with a finger catch for releasing the hook-shaped engaging pawl.

In the case where an article to be accommodated is thinner than a predetermined dimension, the article is clamped with a spring provided on the outer peripheral surface of the intermediate partition of the frame element at a location between the intermediate partition of the frame element and the front-face engaging section.

The front-face engaging section for holding the front-face peripheral edge section of the article to be accommodated is provided at the upper edge of the frame element.

The connecting element may be such that one of the connecting sections is brought to a pivotal connecting section, and the other connecting section is brought to a connecting section which is not pivotal.

At this time, a cap is mounted to an end of a space in the angularly moved frame, in which the article is accommodated.

The sliding contact surface between the connection engaging section of the frame element and the connection engaging section of the connecting element is inclined whereby the connection engaging section of the connecting element is fed axially outwardly of the frame element under the action which moves angularly the frame element outwardly.

In the connecting element, the connection engaging section, the side plate and the angular-movement stoppage section are united together, and a triangular reinforcing plate is formed in unison at the angular-movement stoppage section which is arranged perpendicularly.

DETAILED DESCRIPTION OF THE PREFERRED EMBODIMENT

Figure 1:
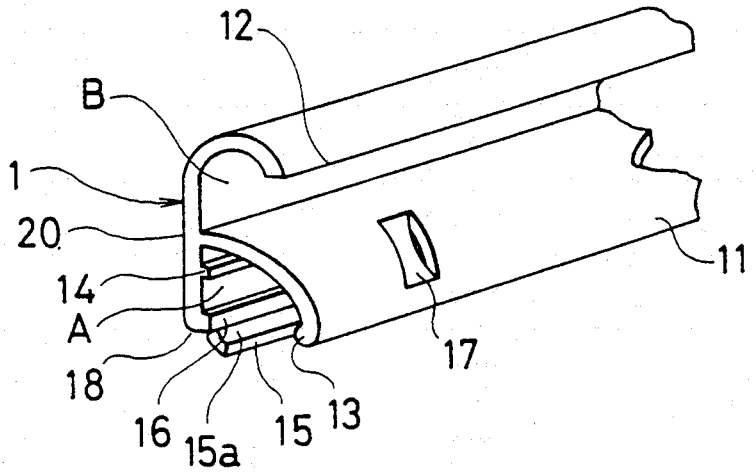
FIG. 1 is a perspective view of a part of one of a plurality of frame elements according to a first preferred embodiment of the invention.
Figure 2:
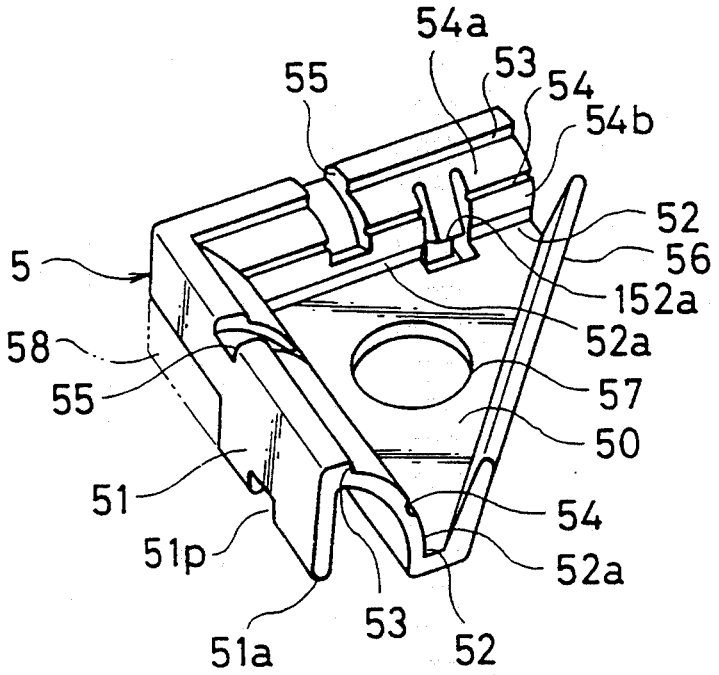
FIG. 2 is a perspective view of one of a plurality of connecting elements according to the first embodiment.

Referring to FIGS. 1 and 2, there is shown a frame which is composed of a plurality of frame elements 1 (only one of which is shown) molding-processed by extrusion of a blank formed of a material such as aluminum or the like, and a plurality of connecting elements 5 (only one shown) molded by elastic resin such as polycarbonate, polyacetal or the like.

Each of the frame elements 1 is formed with an intermediate partition 11 at a side surface of a side plate 20. The intermediate partition 11 is curved convexly downwardly along a longitudinal direction. A front engaging section 12 extending along the longitudinal direction and curved convexly over and toward intermediate partition 11 is formed at an upper edge of the side plate which is provided with an engaging pawl 13.

Figure 7:
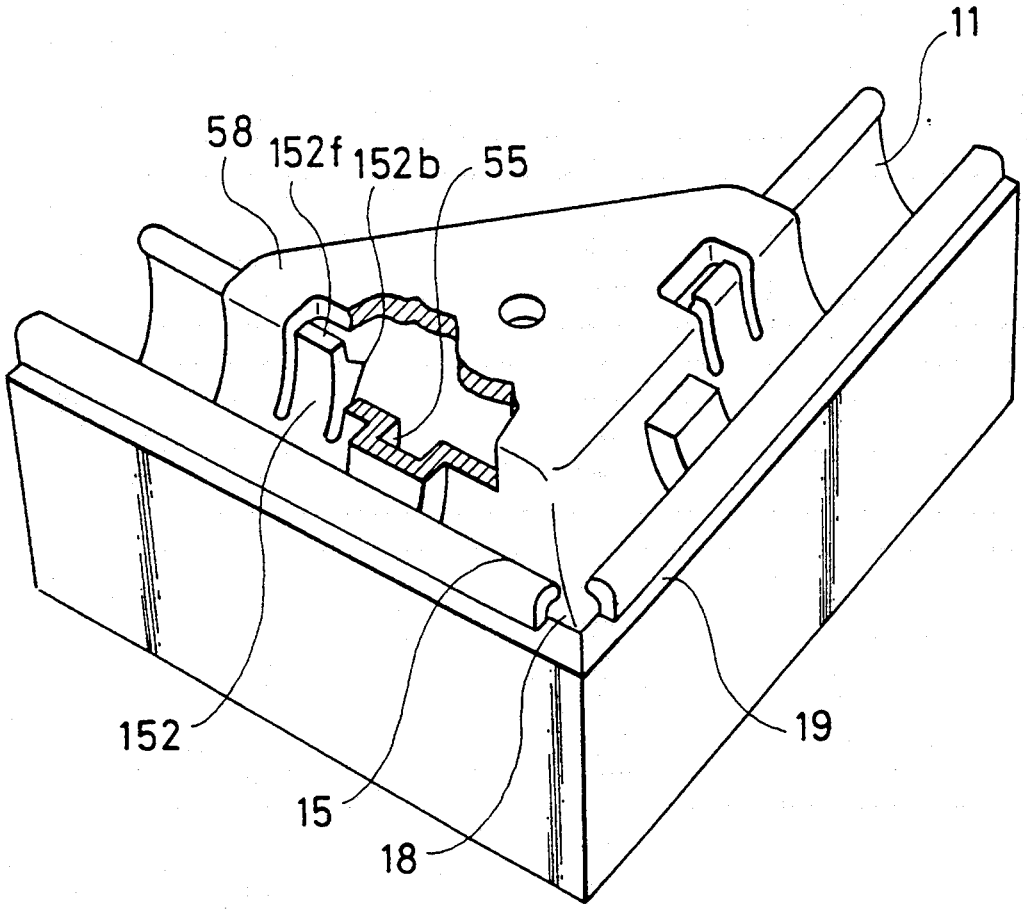
FIG. 7 is a perspective view of a part of the first embodiment as viewed from the bottom.

The side plate 20 is provided with a support section 14 at a location below the intermediate partition 11. The support section 14 is adapted to support the outer side section of the connecting element 5. A flange 15 projects toward the forward end of the intermediate partition 11 from the lowermost edge 18 of the side plate 20, through a step 19 (FIG. 7). Thus, a space A is defined between the side plate 20 and the intermediate partition 11.

The flange 15 is curved to provide a concave partially cylindrical bearing section 15*a*. An antiskid engaging section 16 for receiving a convex by edged shaft section 51*a* of the connecting section 5 is provided adjacent a location above the concave partially cylindrical bearing section 15*a*. A convexly curved connection engaging section 17 engageable with a correspondingly sized connection engaging section 55 of the connecting element 5 is provided on an inner surface of the convexly curved intermediate partition 11.

FIG. 2 shows the connecting element 5, by which two frame elements 1 connect at an angle (as best seen in FIG. 7) to form a corner of a frame, which has a pair of intersecting outer side plates 51 each consisting of a leaf spring extending perpendicularly. An inner surface of each side plate 51 at an upper edge thereof is formed with a first extended angular-movement stoppage section 53 at a position where the frame element 1 is moved to its open position. A pair of convexly curved angular-movement sliding-contact surfaces 54*a* and 54*b* are provided for guiding the engaging pawl 13 of the frame element, each 1 curved in a concentric relation to the center of the concave partially cylindrical section bearing 15*a* (when a frame element 1 is fitted thereto) and formed to extend downwardly away from the first angular-movement stoppage section 53. A second angular-movement stoppage section 54 located midway of angular movement of the frame element 1 is formed, in a concave manner, at a location between the covexly curved angular-movement sliding-contact surfaces 54*a* and 54*b*. A third angular-movement stoppage section 52 is formed at a lower end of the angular-movement sliding-contact surface 54*b* at the time the frame element 1 is moved to its closed position. The connection engaging section 55 engageable with the connection engaging section 17 of the frame element 1 is formed at the upper surface of the side plate 51 and at the upper surfaces of the respective convexly curved surfaces 54*a* and 54*b*. Note that relative angular movement between frame element 1 and the corresponding side of the connecting element is about a direction parallel to the side. A triangular reinforcing plate 50 is formed in unison with the third angular-movement stoppage section 52. The triangular reinforcing plate 50 has its inner edge which is formed with a support wall 56 for an article 3 to be accommodated (refer to FIG. 9). The triangular reinforcing plate 50 is provided therein with a bore 57 for wall surface fixing. A pivot section 51*a* is formed at a part of the lower edge of the side plate 51. In order to form the side plate 51 into a leaf spring, a corner portion of the outer side wall of the side plate 51 is cut out to form a cut-out 58. An inclined surface 52*a* for feeding the engaging pawl 13 of the frame element 1 into the third angular-movement stoppage section 52 is formed at the upper portion of the third angular-movement stoppage section 52. Further, an inclined surface 152*a* may be formed at a forward end of a tongue-like spring 152 which is provided at the curved surfaces 54*a* and 54*b*, to form an angular-movement engaging section.

Figure 3:
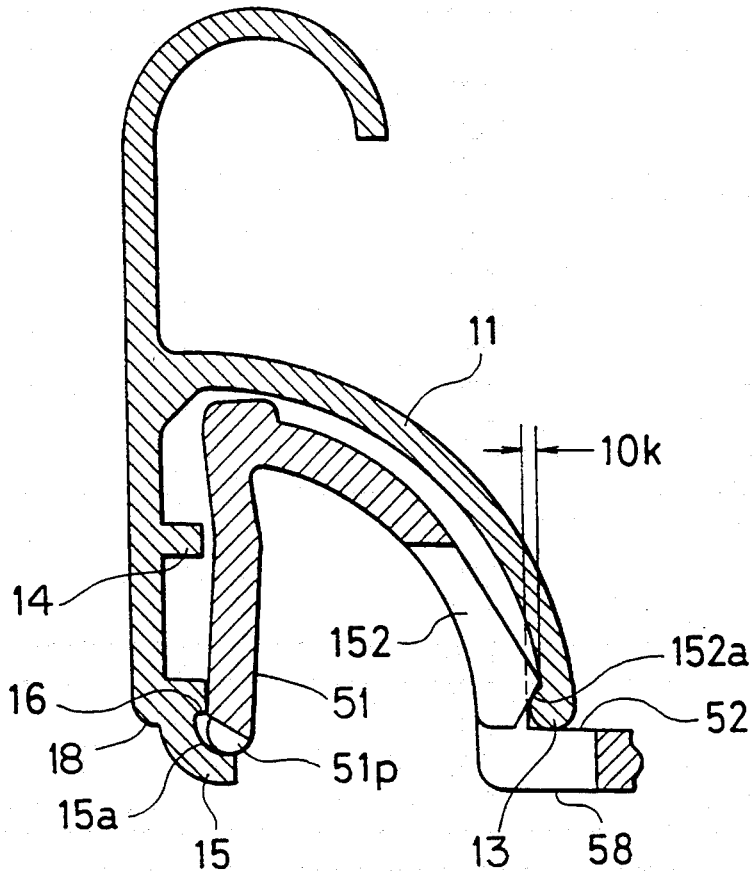
FIG. 3 is a cross-sectional view of a part of the first embodiment.

FIG. 3 shows a condition under which the frame element 1 and the connecting element 5 are fitted in each other. As is readily seen, for example in FIGS. 7, 19, 23 and 42, the intersecting sides of connecting element 5 are formed to be shorter than the frame elements engaged therewith. FIG. 3 illustrates a partial cut-out 51*p* at the forward end of the side plate 51, and an inclined surface 152*a* at the forward end of the tongue-like spring 152.

Figure 4:
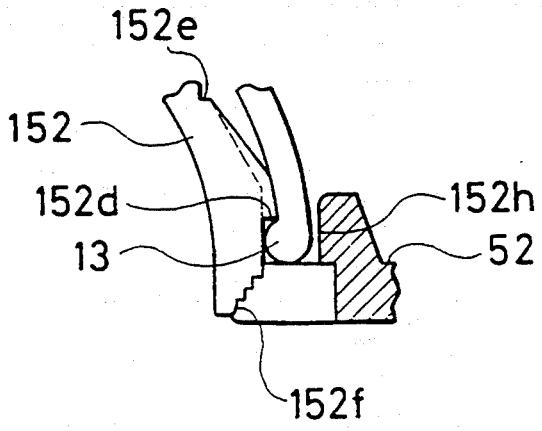
FIG. 4 is a cross-sectional view of a part of a second embodiment.

FIG. 4 shows an embodiment which comprises an angular-movement fixing engaging pawl 152*b* provided on the tongue-like spring 152 engageable with the engaging pawl 13 of the frame element 1, and a clamp wall 152*h* provided on the third angular-movement stoppage section 52.

Figure 5:
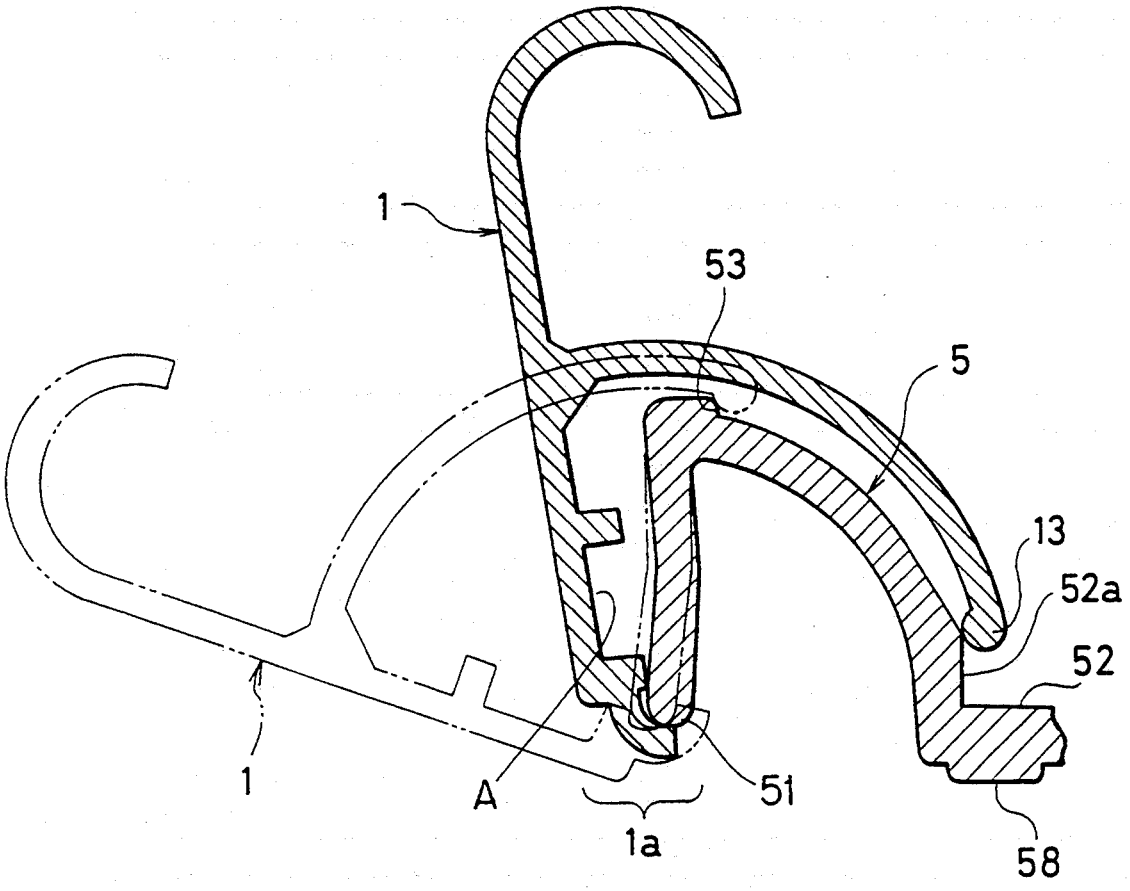
FIG. 5 is a cross-sectional view of a part of the first embodiment at another position.

FIG. 5 shows movement of the engaging pawl 13 of the frame element 1 from the inclined surface 52*a* to the first angular-movement stoppage section 53.

Figure 6:
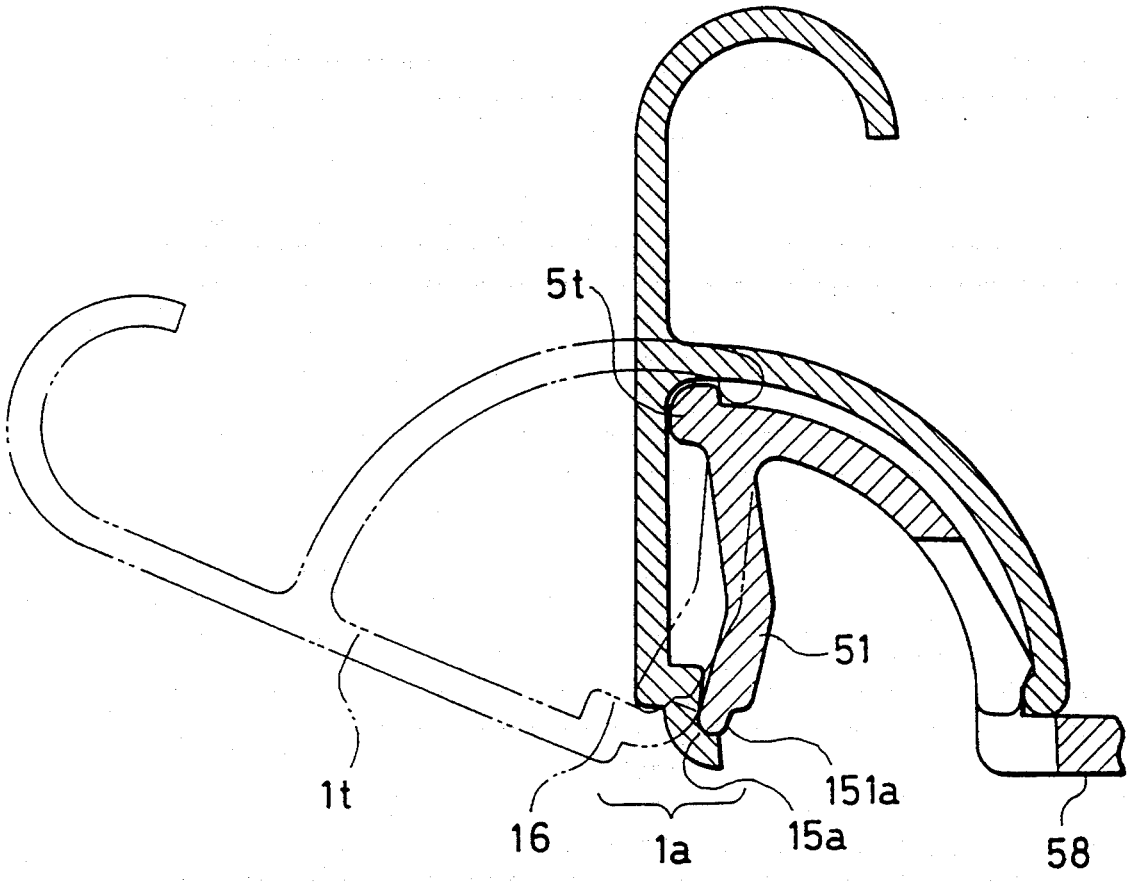
FIG. 6 is a cross-sectional view of a part of a third embodiment.

FIG. 6 shows an embodiment in which curvature of the side plate 51 is made large.

Figure 8:
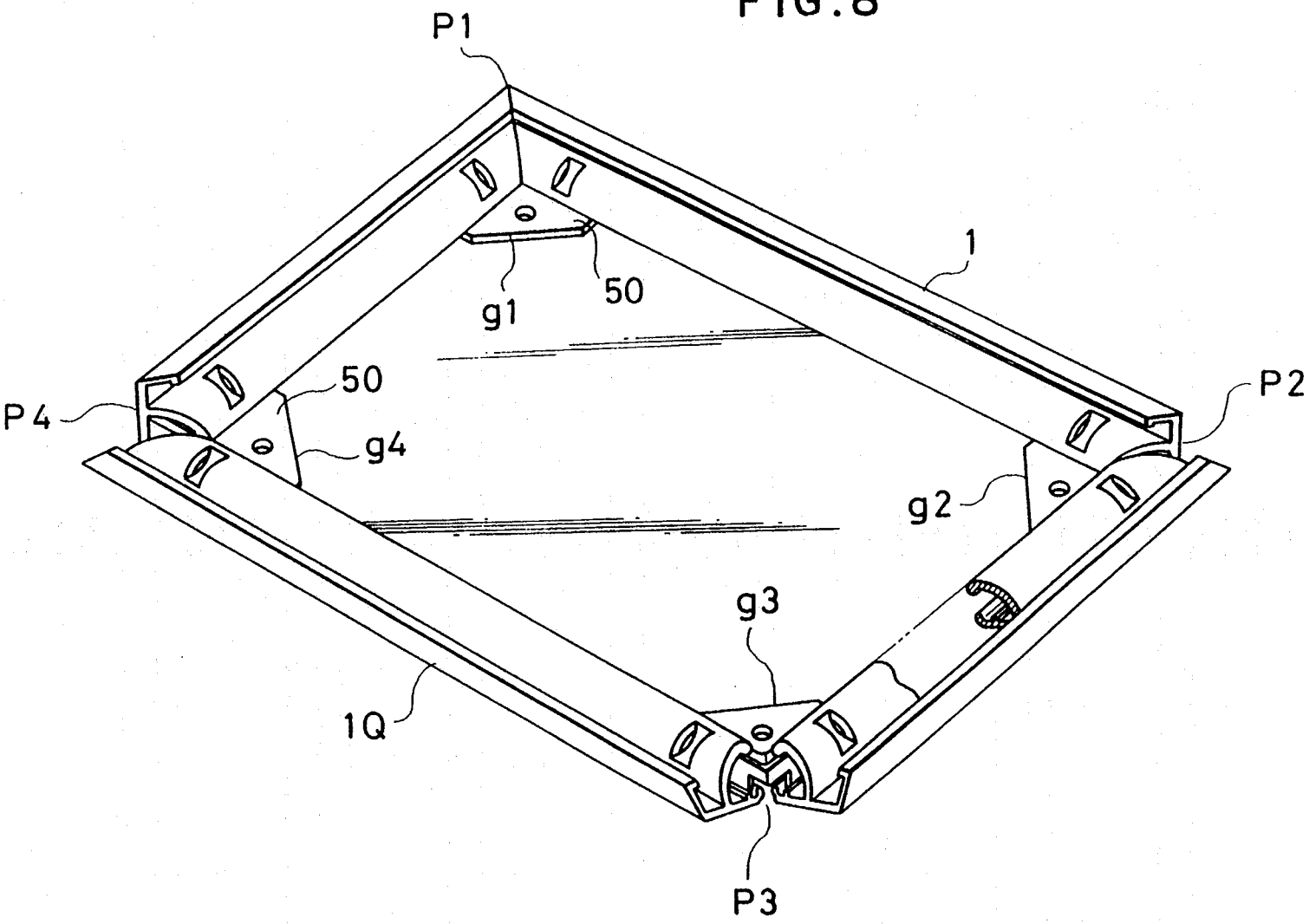
FIG. 8 is a perspective view of the entire frame in which a part of the first embodiment is cut out and parts thereof are removed.

The frame elements 1 and the connecting elements 5 are used at the upper edges of the side plates 51 to form a rectangular frame illustrated in FIG. 8.

Regarding the rectangular frame, assembling of the frame elements 1 and the connecting elements 5, mounting of the article 3 to be accommodated, opening of the frame elements 1, and so on will be described in order.

The frame elements 1 are fitted relative to each other in such a manner that the side plates 51 of the connecting elements 5 illustrated in FIG. 2 are pushed until the third angular-movement stoppage sections 52 are engaged respectively with the engaging pawls 13 of the frame elements 1, from the open sections at the lower ends of the respective spaces A in the frame elements 1 illustrated in FIG. 1. In this manner, the frame elements 1 are connected to each other.

At this time, the side plate 51 is pushed by the flange 15, and is accommodated in the space A in the frame element 1 while being elastically deformed.

Further, the convex shaft section 51*a* of the side plate 51 is in sliding contact with the concave shaft section 15*a* of the frame element 1, and serves as a pivotal section for the frame element 1.

At this time, the connection engaging section 17 of the frame element 1 and the connection engaging section 55 of the connecting element 5 are fitted in each other simultaneously.

When the side plates 51 of the four connecting elements 5 are pushed respectively into the spaces A at both the ends of the four frame elements, assembling of the frame illustrated in FIG. 8 is completed. As illustrated in the various figures, no additional elements are required to maintain the assembly of each of the four frame elements 1 to a corresponding one of the four connecting elements 5 once the frame is assembled.

Figure 9:
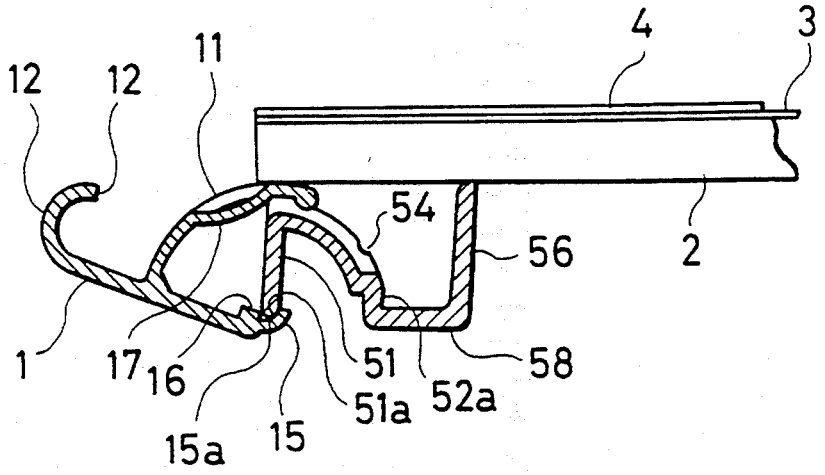
FIG. 9 is a cross-sectional view of the first embodiment, showing the relationship between the first embodiment and an article to be accommodated.
Figure 10:
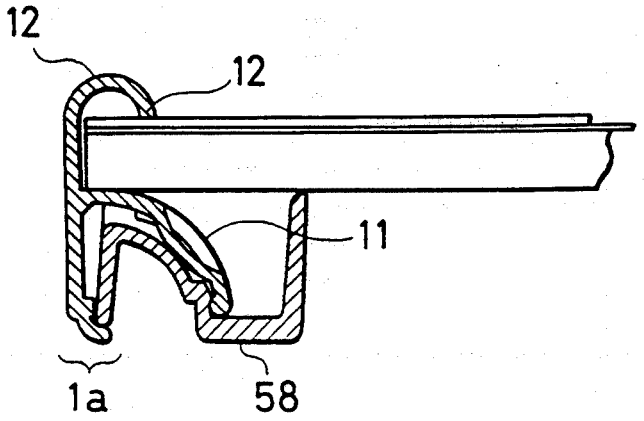
FIG. 10 is a cross-sectional view of FIG. 9 under another condition.
Figure 11:
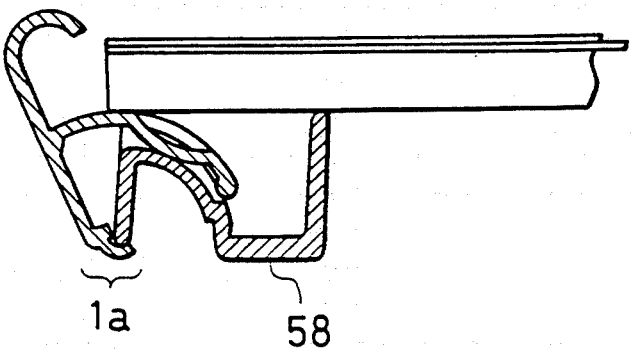
FIG. 11 is a cross-sectional view of FIG. 9 under still another condition.

Mounting of the article 3 to be accommodated is practiced in the following manner. That is, as shown in FIG. 9 or 11, the frame element 1 is moved angularly about the convex shaft section 51*a* of the connecting element 5 and is moved to its open position. The article 3 to be accommodated rests on the curved intermediate partition 11 of the frame element 1. The frame element 1 is again moved angularly about the convex shaft section 51*a* and is moved to its closed position as shown in FIG. 10.

At this time, the curved intermediate partition 11 of the frame element 1 is into sliding contact with the peripheral edge of the article 3 to be accommodated at the rear face thereof, so that the article 3 to be accommodated is held between the intermediate partition 11 and the engaging section 12 of the frame element 11 at the front face thereof.

If the angle of the angular movement of the frame element 1 is made large and, as shown in FIG. 9, if frame element 1 is brought down such that the forward end of the front-face engaging section 12 is located below the forward end of the intermediate partition 11, the article to be accommodated can be taken into and out from the lateral side of the frame element 1.

Further, if the frame elements 1 at the adjacent two sides are moved to their respective open positions as shown in FIG. 8, it is possible to mount and demount the article 3 to be accommodated to and from the frame elements 1 from the above.

Stoppage of the angular movement of the frame element 1 with respect to the connecting element 5 is practiced by the engaging section 13 of the frame element 1 and the first through third angular-movement stoppage sections 53, 54 and 52 of the connecting element 5.

It is possible to optionally set resistance at stoppage by the spring strength of the side plate 51 and/or the spring strength of the intermediate partition 11 of the frame element 1.

The inclined surface 52*a* provided in front of the third angular-movement stoppage section 52 shown in FIG. 5 serves to feed the engaging pawl 13 of the frame element 1 into the stoppage section 52.

The engaging section 13 of the frame element 1 is urged against the third stoppage section 52 by the inclined surface 52*a*, so that it is possible to prevent the frame element 1 from being inadvertently moved to its open position with respect to the connecting element 5.

The angle between the inclined surface 52*a* and the third stoppage section 52 is made acute, whereby it is possible to fixedly mount the frame element 1 to the connecting element 5 with a strong force.

Furthermore, as shown in FIG. 3, the steep inclined surface 152*a* is provided in front of a tongue-like spring 152 which is provided at the pair of curved surfaces 54*a* and 54*b* of the connecting element 5. The tongue-like spring 152 is urged toward the interior of the connecting element at sliding contact between the curved surfaces 54*a* and 54*b* and the engaging section 13. Thus, the engaging section 13 of the frame element 1 is engaged with the steep inclined surface 152*a*.

The strength of the engagement is adjusted by appropriate of the choice material and configuration of the tongue-like element 152, the angle of the inclined surface 152*a*, and the like.

The arrangement may be such that the forward end of the tongue-like spring 152 is not brought to the inclined surface 152*a*, but, as shown in FIG. 4, is brought to an engaging pawl 152*d*, so that the forward end of the tongue-like spring 152 is brought to an antiskid engaging section in mesh with the engaging section 13.

Moreover, the arrangement may be such that the engaging pawl 152*d* and the inclined surfaces 52*a* of the curved surfaces 54*a* and 54*b* are used together, the engaging pawl 152*d* of the tongue-like spring 152 can be broken and cut at a cut-out 152*e*, the broken and cut frame element 1 is brought to a frame section which is movable angularly, and the frame element 1, in which the engaging pawl 152*d* of the tongue-like spring 152 is maintained as it is, is brought to an immovable frame section. In this manner, it is possible to optionally form the angularly-movable frame section and the angularly-immovable frame section by the same connecting element 5.

A fixing releasing pawl or a finger catch 152*f* for the engaging pawl 152*d* is provided at the lower end of the tongue-like element 152.

The arrangement may be such that another element (not shown) is assembled in substitution for the engaging pawl 152*d* provided at the tongue-like spring 152 according to the embodiment, to optionally practice switching of engaging and disengagement of the engaging section 13.

In order to enhance close contact between the corner of the frame element 1 and the corner of the tablet, the frame element 1 having its corner cut through 45 degrees is mounted to the connecting element 5. When the frame elements 1 are moved angularly toward the outside from the condition that the cut surfaces of the frame elements 1 are abutted against each other, portions of the frame elements 1 getting inwardly of the convex shaft sections 51*a* impinge against each other and become immovable. Accordingly, in order to avoid such collision, as shown in FIG. 7, a cut-out 18 must be provided at the ends of the adjacent flange 15.

In the case where the tablet is seen as a commodity, the cut-outs 18 serve as such severe defects that bores are formed respectively at the corners of the tablet.

Close fitting at the corners of the tablet requires a close-fitting accuracy of the corners, as will be called life of the tablet.

Further if the feeding force of the inclined surface 52*a* is made large and if the forward end of the convex shaft section 51*a* is moved outwardly together with opening of the shaft element 1 as shown in FIGS. 5 and 6, the convex bearing section 15*a* of the frame element 1 is pushed outwardly by the spring action of the side plate 51.

In this manner, the spring force of the side plate 51 moves the concave bearing section 15*a* of the frame element 1' outwardly, as indicated by the phantom lines in FIGS. 5 and 6, when the frame element 1 is angularly moved outwardly so as to be opened.

When the concave bearing section 15*a* is moved outwardly under the spring force of the side plate 51, the impinging portion between the end face of the frame element 1 and the end face of the adjacent frame element 1 during angular movement thereof is reduced correspondingly to the outward movement. Accordingly, it will suffice that the cut-out 18 is small.

Moreover, in order to make the cut-out 18 even smaller, as shown in FIG. 6, a thin-wall section 151*a* may be provided at the forward end of the side plate 51 to reduce the convex shaft section 51*a*.

Alternatively, if a metallic spring of the order of 0.4 mm to 0.5 mm is assembled as the convex shaft section 51*a*, it is possible to further reduce the convex shaft section 51*a*.

Furthermore, if the sliding contact surface between the connection engaging section 17 of the frame element 1 and the connection engaging section 55 of the connecting element 5 is brought to a screw-feeding inclined surface, closing angular movement of the frame element 1 enables the connecting element 5 to be drawn into the space Δ in the axial direction of the angular movement.

Further, such angular movement as to move the frame element 1 to its open position enables the connecting element 5 to be fed outwardly of the angular movement shaft from the space Δ.

As a result, it is possible to move the center of the convex shaft section 51*a* outwardly of the surrounding of the frame elements 1.

Furthermore, as shown in FIG. 7, if the step 19 projecting upwardly of the cut-out 18 is provided so that it is made difficult to view the cut-out 18 from the forward portion of the tablet, the arrangement is further effective.

In the case where the article 3 to be accommodated has a relatively small thickness, there may be concern that a gap with occur between the front-face engaging section 12 of the frame element 1 and the article 3 to be accommodated.

Figure 12:
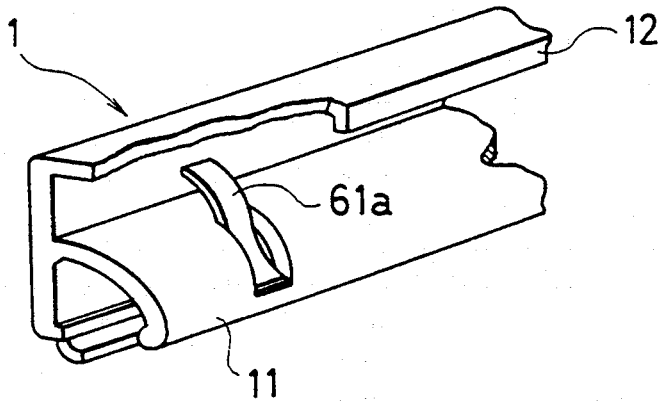
FIG. 12 is a fragmentary partially cut-out perspective view of a frame element according to a fourth embodiment.
Figure 13:
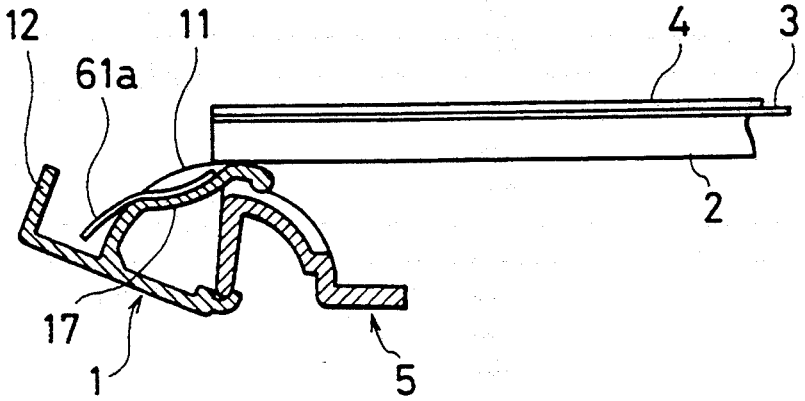
FIG. 13 is a cross-sectional view of the embodiment illustrated in FIG. 12.
Figure 14:
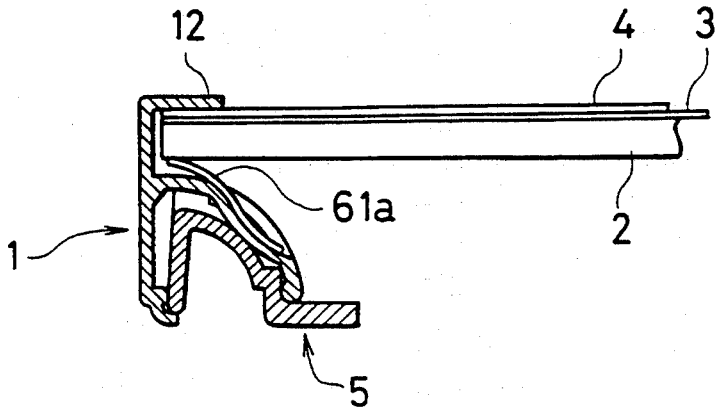
FIG. 14 is a cross-sectional view of FIG. 3 under another condition.

In order to avoid this problem, in the embodiment illustrated in FIGS. 12 through 14, a leaf spring 61*a* located in the intermediate partition 11 is mounted to a space between the intermediate partition 11 and the front-face engaging section 12 of the frame element 1. With such an arrangement, the article 3 to be accommodated is pushed from its rear face by the leaf spring 61*a*, while the frame element 1 is moved to its closed position from the condition that the article 3 to be accommodated rests on the intermediate partition 11, and is urged against the front-face engaging section 12 of the frame element 1. Thus, the above-described gap is prevented from occurring.

Figure 15:
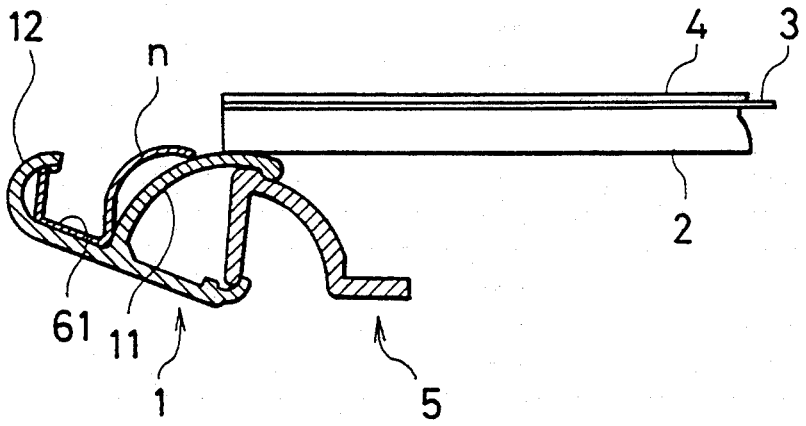
FIG. 15 is a cross-sectional view of a fifth embodiment.
Figure 16:
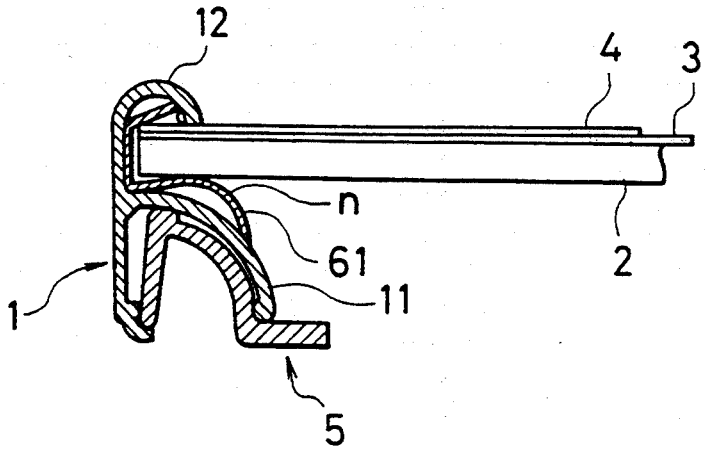
FIG. 16 is a cross-sectional view of FIG. 15 under another condition.

Furthermore, in an embodiment illustrated in FIGS. 15 and 16, a leaf spring 61 folded in a thin configuration and having a lower portion curved at n is fixedly mounted to a position between the intermediate partition 11 and the front-face engaging section 12 of the frame element 1. Thus, it is possible to produce similar functional advantages. The configuration and the mounting position of the connecting engaging sections 55 and 17 of the respective frame element 1 and connecting element 5 are determined depending upon the fact that the connecting section for preventing movement of the frame element 1 and the connecting element 5 in the angular-movement axial direction is brought to detachable type or fixing type.

In the case where the connection section is to be of a detachable type, the left- and right-hand frame elements 1 adjacent the frame element 1 to be demounted are moved angularly to a predetermined angle and are moved to their open positions. The groove in the connection engaging section 55 of the connecting element 5 and the projection on the connection engaging section 17 of the frame element 1 are aligned with each other.

The intermediate frame element 1 is pushed up and is released.

The predetermined angle is determined depending upon a feeling on the circumstances or knowledge of use such as the fully open position of the frame element 1, a position midway of the angular movement, or the like.

In connection with the above, it is further convenient if a temporary stop is provided midway of the angular movement and is combined with means for perceiving each position.

Release between the frame elements 1 and the connecting elements 2 can also be done by the following method.

A lower end of the side plate 51, which serves as the convex shaft section 51*a* within the concave bearing section 15*a* of the frame element 1, is partially cut out, to form a partial cut-out 51*p* as shown in FIGS. 2 and 3. A screwdriver may be applied with its forward end abutted against the partial cut-out 51*p*. A force is applied via the screwdriver with the edge of the flange 15 of the frame element 1 serving as a fulcrum. The side plate 51 is thus elastically deformed, and the convex shaft section 51*a* is detached from the concave bearing section 15*a* of the frame element 1.

In another embodiment (not shown), both the ends of the frame element 1 shown in FIG. 1 are cut at 45 degrees. A pair of V-shaped cut-into sections are formed into two intermediate locations from the interior under such a condition that the side plate 18 of the frame element 1 remains to be cut. The pair of cut-into sections are bent into such a configuration that three sides are surrounded. The couplings 5 shown in FIG. 2 are connected respectively to both end faces.

The connecting elements 5 are fitted respectively into the spaces Δ at both the ends of another frame element 1 which has its length the same as that between the V-shaped cut-into sections. Thus, there is obtained a frame in which only one side of the frame is movable angularly.

In this case, it is also possible to angularly move the angularly-movable frame element 1 whereby the article 3 to be accommodated is drawn from the side face of the frame.

The foregoing will be described further with reference to FIG. 8. The connecting elements g1 and g2 are omitted, and the interior of the single frame element 1 at the positions p1 and p2 are cut into a V-shaped configuration, and are bent.

An assembly, in which the connecting elements g3 and g4 are fitted in both ends of another frame element 1Q, is pushed into the ends p3 and p4 of the frame element, to form a frame.

As shown in FIG. 5, if the lower section of the connecting element 5 projects with respect to a horizontal position of a rear-face section 1*a* of the frame element 1 to provide a projection 58, it is possible to move the frame element 1 angularly without contact of the lower portion of the rear-face section 1*a* of the frame element 1 with the wall surface. In this case, it is possible to replace the article 3 to be accommodated by another one, while the connecting element 5 is mounted to the wall surface or the like.

Figure 17:
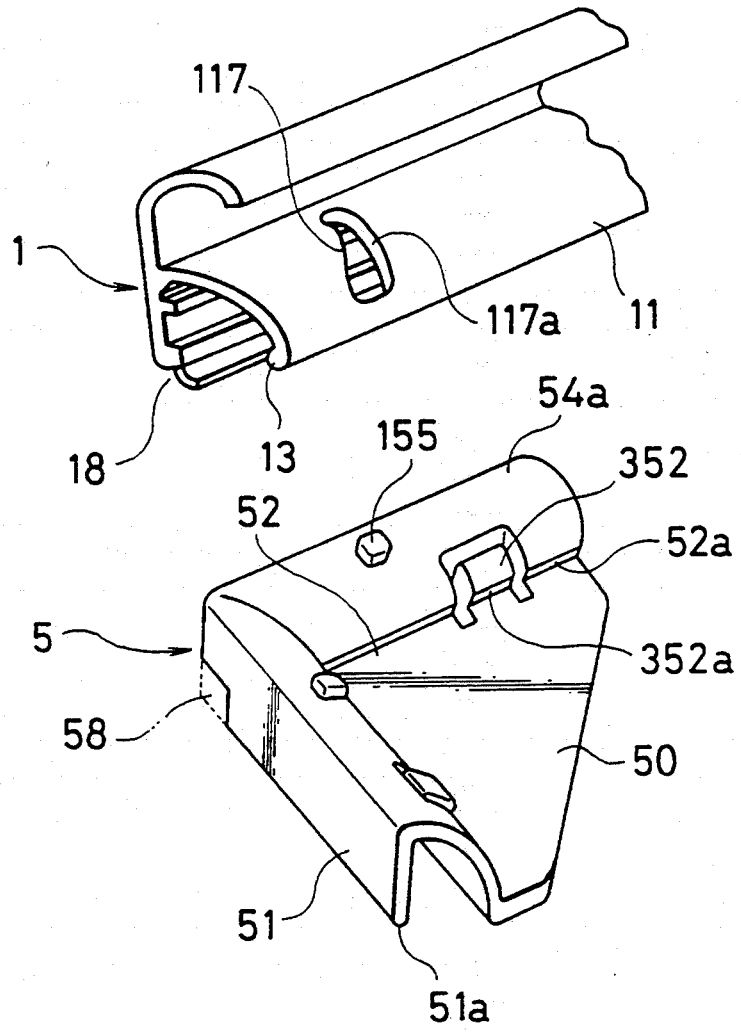
FIG. 17 is an exploded perspective view of a sixth embodiment.

An embodiment illustrated in FIG. 17 is such that a connection engaging inclined surface 117*a* of a connection engaging section consisting of a fitting bore 117 having its upper section formed narrow, which is provided on the intermediate partition 11 of the frame element 1, is in sliding contact with a connection engaging section 155 which consists of a projection provided on the connecting element 5.

Angular movement of the frame element 1 causes the inclined surface 117*a* to clamp the connection engaging section 155 of the connecting element 5 at the connection engaging section 117 of the frame element 1, or to release the clamping.

In this embodiment, an inclined surface 352*a* is provided on a tongue-like spring 352 which is connected to the reinforcing plate 50 and which is formed with a cut groove at its three sides. The inclined surface 352*a* is engageable with the engaging pawl 13 which is provided on the intermediate partition 11 of the frame element 1.

Figure 18:
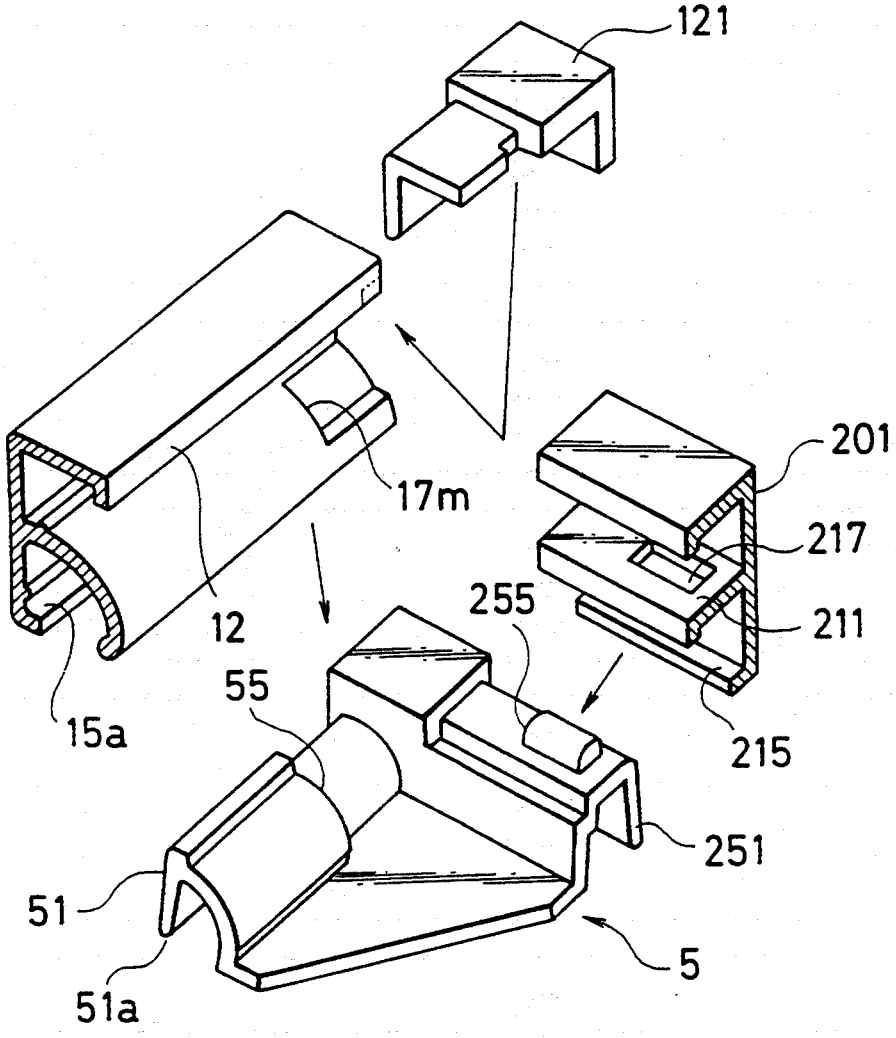
FIG. 18 is an exploded perspective view of a seventh embodiment.
Figure 19:
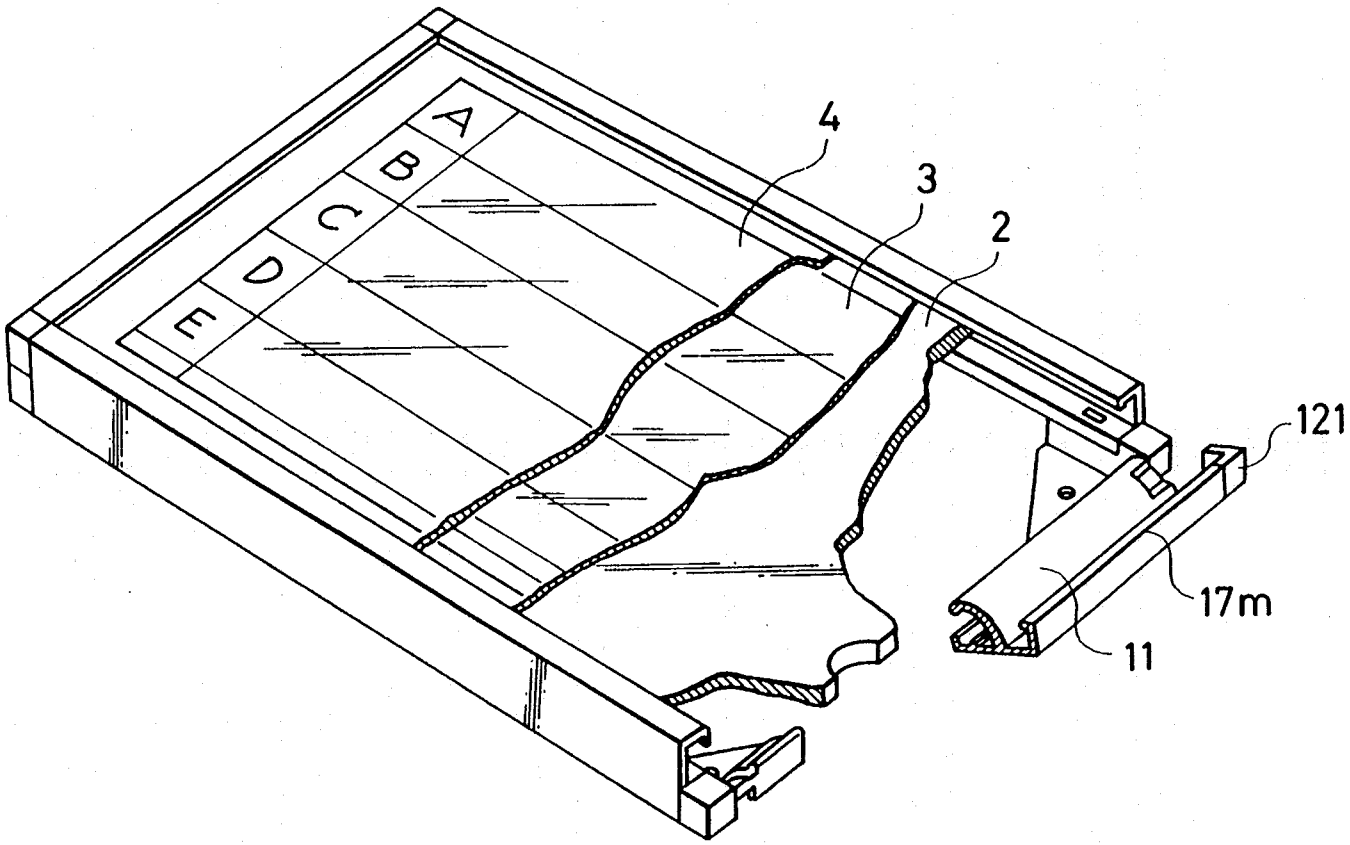
FIG. 19 is a partially cut-out perspective view of the entire embodiment illustrated in FIG. 18.
Figure 20:
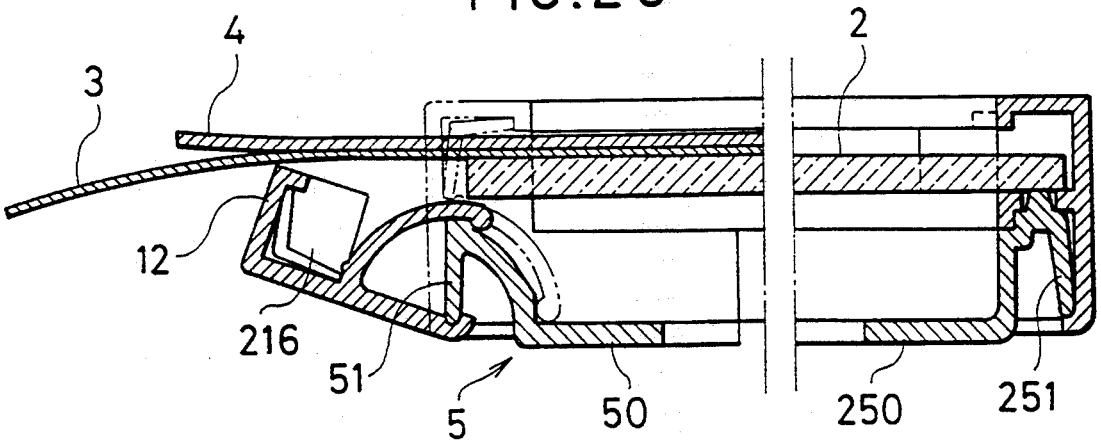
FIG. 20 is a cross-sectional view of an eighth embodiment.

FIGS. 18 through 20 show an embodiment in the case where a frame element 1 is one in which each end is cut perpendicularly.

The connecting element in the embodiment uses a pair of connecting sections, one being angularly movable, and the other being immovable angularly. A pair of caps 121 are mounted respectively to both the ends of the front-face engaging section 12 of the frame element 1 which is located at the front face of the article 3 to be accommodated.

One of a pair of side plates 251 in the connecting element 5 serves as a spring element when the one side plate 251 is fitted in an engaged with an inside of a flange 215 which is formed at a lower end of one frame element 201.

A bore 217 formed in an intermediate partition 211 of the one frame element 201 serves as a connection engaging section which is capable of being fitted about a projection 255 formed on the one side plate 251 of the connecting element 5.

If the end of the frame element 1 is cut perpendicularly as is in the present embodiment, the corner of the frame element 1 is not brought to a sharp configuration.

Further, since the cap 121 is mounted to the end of the angularly movable frame element 1, it is possible to eliminate a further acute feeling.

Figure 21:
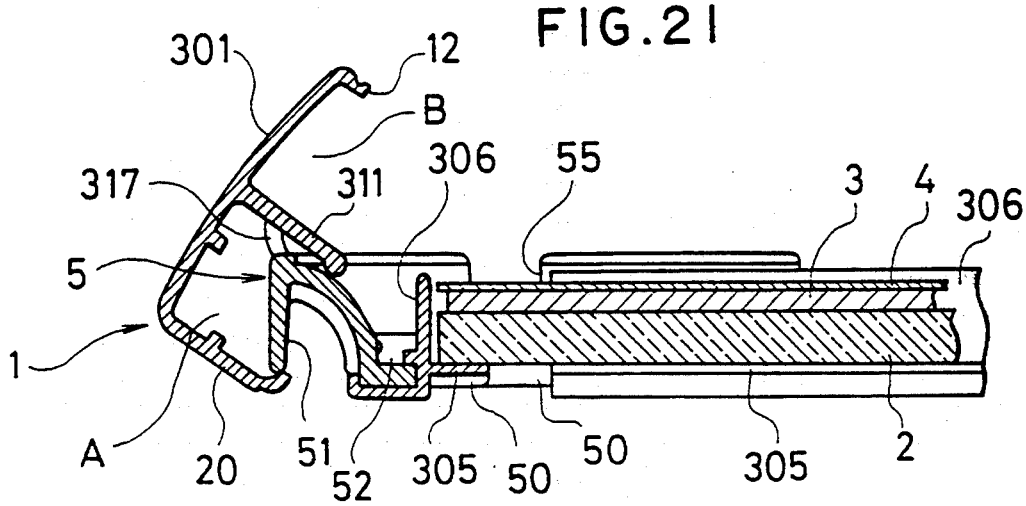
FIG. 21 is a cross-sectional view of a ninth embodiment.

The embodiment illustrated in FIG. 21 is one in which the configuration of the frame element 1 is made flat and thin.

In the embodiments illustrated in FIGS. 1 and 18, the space A of the frame element 1 and a holding space B for the article to be accommodated are arranged in the thickness direction of the frame.

Instead the embodiment illustrated in FIG. 21 is such that the frame element 1 has a top plate 301 connected to the side plate 20, a partition plate 311 is provided on the top plate 301, and the space A and the clamping space B for the article to be accommodated are arranged horizontally.

The article 3 to be accommodate is clamped between a bottom wall 305 and a side wall 306 of the reinforcing plate 50 fitted in the bottom of the connecting element 5 and the front-face engaging section 12 provided on the inner edge of the top plate 301 of the frame element 1.

Figure 22:
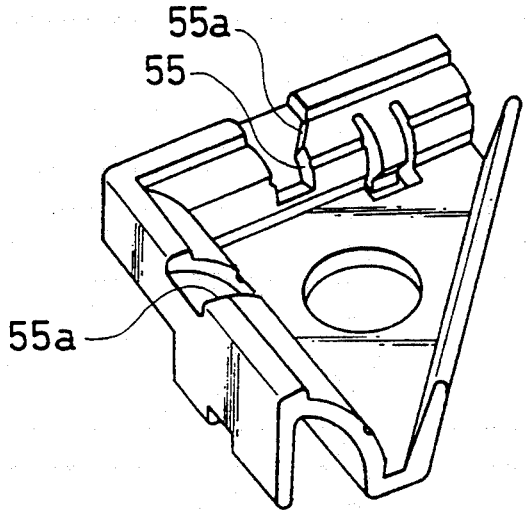
FIG. 22 is a perspective view of a connecting element according to a tenth embodiment.

FIG. 22 shows an embodiment in which an inclined surface 55*a* for moving the connecting element 5 in the angular-moving axial direction of the frame element 1, accompanied with the angular movement of the frame element 1 illustrated in FIG. 17, is provided on the connection engaging section 55 of the connecting element 5.

In this case, the projection-like connection engaging section 17 of the frame element 1 may be one illustrated in FIG. 1.

Figure 23:
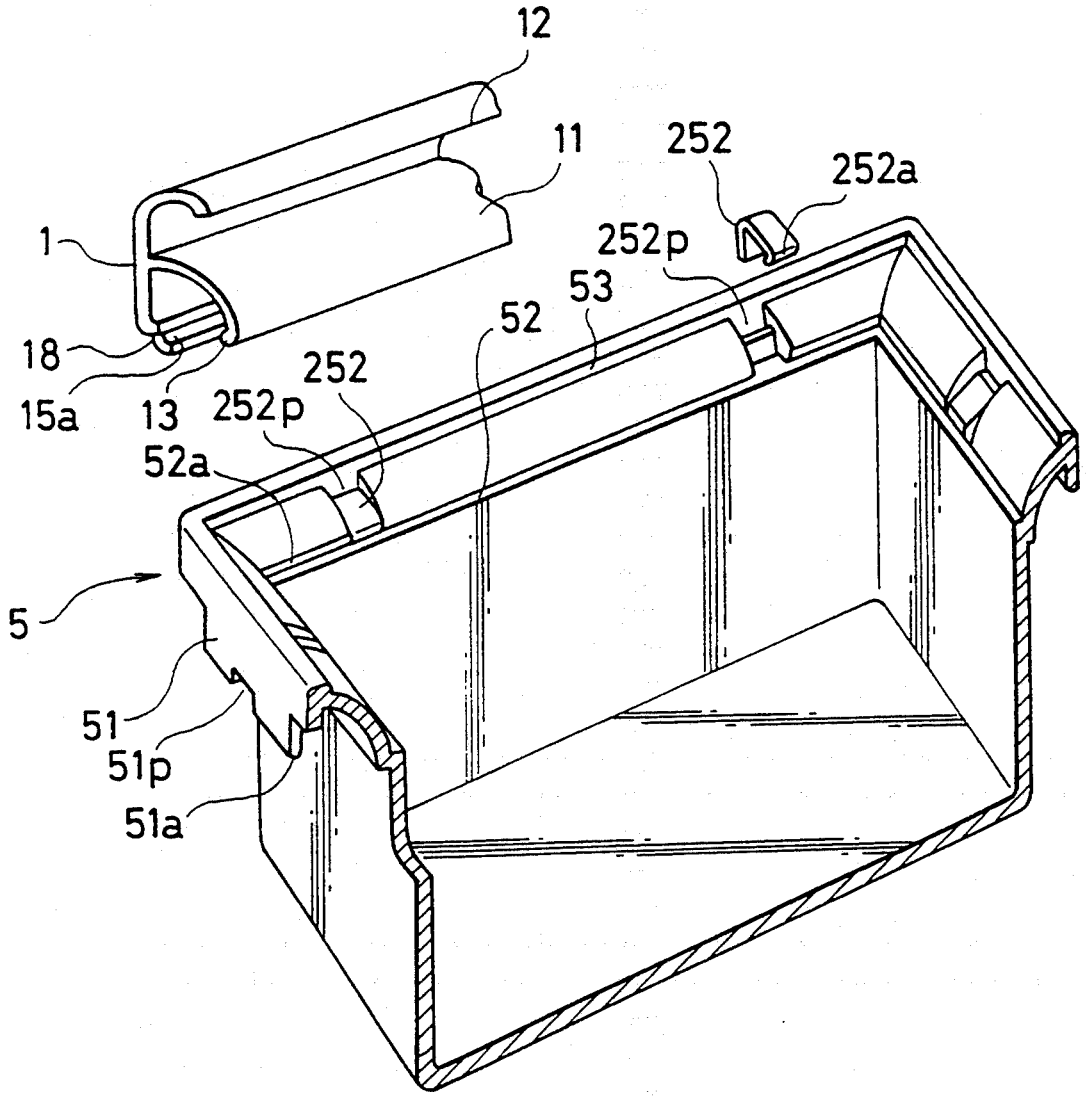
FIG. 23 is a partially broken-away perspective view of an eleventh embodiment.

FIG. 23 shows an embodiment in the case where the frame elements 1 according to the invention are mounted respectively to the connecting elements 5 formed at an edge of a box.

In the present embodiment, a plurality of pockets 252*p* are formed at the edge of the box, and a plurality of leaf springs 252 each having an inclined surface 252*a* are mounted respectively to the pockets 252*p*.

The inclined surface 252*a* serves similarly as the inclined surface 152*a* illustrated in FIG. 2.

Figure 24:
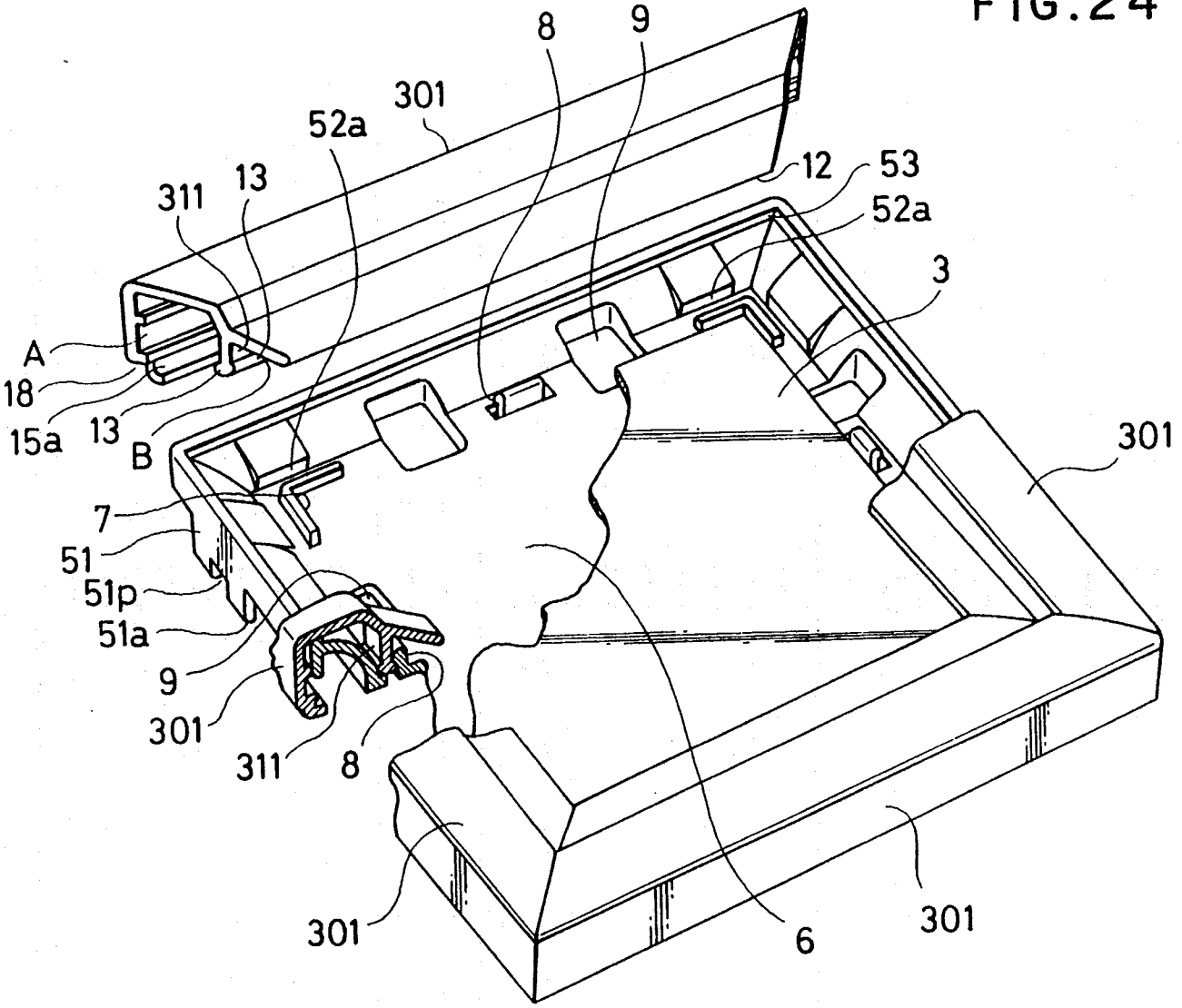
FIG. 24 is a partially cut-out perspective view of a twelfth embodiment.

FIG. 24 shows an embodiment of a frame which comprises a connecting element and a plurality of frame elements 301. In the connecting element, a plurality of holding projections 7 for the article 3 to be accommodated are formed respectively at the corners of a dish-like rear plate 6. The dish-like rear plate 6 has its edges each of which is provided with an engaging pawl 8 and a finger-catching recess 9' for removing the article 3 to be accommodated. Each of the frame elements 301 is provided with an engaging pawl 13 which is engageable with the engaging pawl 8 of the dish-like rear plate 6.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. A frame, comprising:

a plurality of elongate frame elements each of a respective predetermined length; and at least one connecting corner element, having sides intersecting to form an outside corner and to be shorter than said frame elements, to which sides said frame elements are respectively mounted to be disposed angularly with respect to each other, said sides defining with said frame elements means for engaging therewith in a manner permitting angular movement therebetween, wherein at least one of said frame elements is mounted to a corresponding side of said at least one connecting corner element for retention solely thereby and in a manner permitting said angular movement relative thereto about a direction parallel to said corresponding side.

2. The frame according to claim 1, wherein: each of said frame elements is divided into first and second portions by a corresponding one of a plurality of intermediate partitions, said first portion being formed to define a first space for holding a front-face peripheral edge of an article to be accommodated, and said second portion being formed to define a second space in which said connecting corner element is fitted.

3. The frame according to claim 2, wherein: said second space of each of the frame elements, into which said at least one connecting corner element is fitted, has a lower end provided with an inward flange having a concave bearing section.

4. The frame according to claim 2, wherein:

said corresponding intermediate partition is formed to have an angular-movement engaging section.

5. The frame according to claim 1, further comprising:

an angular-movement stoppage section provided at an angular-movement sliding-contact surface between said at least one connecting corner element and a frame element engaged therewith.

6. The frame according to claim 1, further comprising:

an angular-movement engaging section provided at an intermediate section of an angular-movement sliding surface between said at least one connecting corner element and a frame element engaged therewith.

7. The frame according to claim 1, wherein:

the frame element has a side plate and an upper plate connected to said side plate, and wherein a clamping space for the article to be accommodated is formed between a front-face engaging section provided on an inner edge of said upper plate and a bottom plate and a side plate of said at least one connecting corner element.

8. The frame according to claim 1, wherein:

the frame element and said at least one connecting corner element have respective connection engaging sections for restricting relative movement between the frame element and said at least one connecting corner element in an angular-movement axial direction.

9. The frame according to claim 8, wherein:

each of said connection engaging sections has an inclined side surface.

10. A frame comprising:

a plurality of frame elements, each including an intermediate partition formed longitudinally along a side surface of a frame element side plate, a front engaging section formed along an upper edge of said side plate to be extending over the intermediate partition and defining a predetermined interval provided with respect to said intermediate partition for accommodating an object to be contained, and an engaging pawl provided at a front end of said intermediate partition; and a plurality of connecting elements cooperating with said frame elements to define said frame, each connecting element including a frame element fitting section and an angular-movement stoppage section provided orthogonally to the frame element fitting section, the angular-movement stoppage section being formed for engaging with an engaging pawl provided at a front end of the intermediate partition of a cooperating frame element to hold said cooperating frame element in an engaged position with respect to the corresponding connecting element, wherein, said frame element fitting section of each connecting element comprises a convex shaft section formed at a lower end of a connecting element side plate, each frame element is formed to have a concave bearing section at the lower end of said frame element side plate, and the convex shaft section of each connecting element engages with the concave bearing section of a cooperating frame element.

11. A frame comprising:

a plurality of frame elements, each including an intermediate partition formed longitudinally along a side surface of a frame element side plate, a front engaging section formed along an upper edge of said side plate to be extending over the intermediate partition and defining a predetermined interval provided with respect to said intermediate partition for accommodating an object to be contained, and an engaging pawl provided at a front end of said intermediate partition; and a plurality of connecting elements cooperating with said frame elements to define said frame, each connecting element including a frame element fitting section and an angular-movement stoppage section provided orthogonally to the frame element fitting section, the angular-movement stoppage section being formed for engaging with an engaging pawl provided at a front end of the intermediate partition of a cooperating frame element to hold said cooperating frame element in an engaged position with respect to the corresponding connecting element, wherein each frame element is provided with a flange projecting inward from the side plate thereof to engage with a convex shaft section of a cooperating connecting element.

* * * * *